US007269490B2

(12) United States Patent
Matsuda

(10) Patent No.: US 7,269,490 B2
(45) Date of Patent: Sep. 11, 2007

(54) CONSTRUCTION MACHINE

(75) Inventor: Mitsunori Matsuda, Hirakata (JP)

(73) Assignee: Komatsu Ltd., Tokyo (JP)

( * ) Notice: Subject to any disclaimer, the term of this patent is extended or adjusted under 35 U.S.C. 154(b) by 353 days.

(21) Appl. No.: 10/924,198

(22) Filed: Aug. 24, 2004

(65) Prior Publication Data

US 2005/0149244 A1 Jul. 7, 2005

(30) Foreign Application Priority Data

Aug. 25, 2003 (JP) ..... 2003-300517

(51) Int. Cl.
*E02F 9/26* (2006.01)
*G06F 19/00* (2006.01)

(52) U.S. Cl. ..... 701/50; 340/438; 340/468

(58) Field of Classification Search ..... None
See application file for complete search history.

(56) References Cited

U.S. PATENT DOCUMENTS 4,779,591 A * 10/1988 Tordenmalm ..... 123/352
5,481,875 A 1/1996 Takamura et al. ..... 60/443
6,176,126 B1 * 1/2001 Tsuruga et al. ..... 73/118.1
6,450,284 B1 * 9/2002 Sakyo et al. ..... 180/329
2002/0118103 A1 * 8/2002 Tabe ..... 340/436
2006/0200292 A1 * 9/2006 Asakage ..... 701/50

FOREIGN PATENT DOCUMENTS

JP 10-274068 * 10/1998
JP 2002-13425 1/2002
JP 2002-285890 10/2002
WO WO93/06314 4/1993
WO WO 2004/067939 A1 * 8/2004

* cited by examiner

*Primary Examiner*—Michael J. Zanelli
(74) *Attorney, Agent, or Firm*—Kratz, Quintos & Hanson, LLP

(57) ABSTRACT

A construction machine capable of notifying an operator or the like of an energy saving state such that an engine thereof stops irrespective of the operator's will. The construction machine, wherein its engine is controlled to be in an energy saving state when an operator leaves from an operator's seat and no work is performed, includes various display devices for displaying the energy saving state. The various display devices include a display lamp that is capable of being recognized from the outside of the machine, and a monitor screen that is provided in an operator's cabin as a monitor display.

7 Claims, 4 Drawing Sheets

CONSTRUCTION MACHINE

BACKGROUND OF THE INVENTION

1. Field of the Invention

The present invention relates to a construction machine such as a hydraulic excavator or the like.

2. Description of the Related Art

In recent years, a construction machine is known, wherein its engine automatically stops for energy saving and environmental protection after the lapse of a predetermined time since an operator leaves from the operator's seat without stopping the engine (for example, refer to Japanese Patent Laid-open Publication No. 2002-13425 (P. 4, FIGS. 2 to 4)). In other words, providing detection means for detecting the operator at the operator's seat and detecting if the operator is located at the operator's seat by means of this detection means, if the operator is not located at the operator's seat and a predetermined time has lapsed without the operator there, the engine is stopped. Therefore, without stopping the engine during work, if the operator leaves from the operator's seat, the engine is stopped irrespective of the operator's will.

In the meantime, in the case of performing the operation by the construction machine, according to a general hydraulic excavator, a bucket is grounded in a state of the end of work. However, when the operator leaves from the operator's seat once temporarily during work and returns to start the work again, it is often the case that the operator leaves from the operator's seat without stopping the engine and without making the construction machine into the state of the end of work. However, if the operator leaves from the operator's seat during the work, according to the construction machine described in the above-described patent document 1, the engine is stopped irrespective of the operator's will. Therefore, when the operator returns to the operator's seat to start the engine, the construction machine is not in the state of the end of work, so that it is feared that the construction machine operates in an unexpected manner. In addition, in the end of work, the operator stops the engine with a key turned off or a key pulled out and a ventilation operation also stops. However, even if the engine stops in an energy saving state, the ventilation operation or the like has been continued. As a result, the operator other than the operator who suspends the work boards at this construction machine without grasping that the engine stops in the energy saving state, if the ventilation operation or the like is performed, this causes the operator to feel anxieties because he or she has no idea of why the ventilation operation or the like is performed.

SUMMARY OF THE INVENTION

The present invention has been made taking the foregoing problems into consideration and an object of which is to provide a construction machine capable of notifying an operator or the like of an energy saving state such that an engine thereof stops irrespective of the operator's will or the like.

According to a first aspect of the invention, a construction machine wherein its engine is made in an energy saving state when an operator leaves from the operator's seat 13 and no work is performed may include display means 30 for displaying the energy saving state.

According to the construction machine of the first aspect of the invention, since this state is displayed by the display means 30 when the engine is made in the energy saving state, the operator can know the state (condition) of this construction machine. In the meantime, the energy saving state means a state such that the work using an operating machine or the like and the traveling operation are not performed, for example, when the engine is made in a low rotation state as an idling state; when the engine is made in a further low rotation state after the lapse of a predetermined time from the above low rotation state; when the engine stops after the lapse of a predetermined time from these low rotation states (the rotation state upon idling or the further low rotation state from the idling state); and when the construction machine is made in an automatic deceleration state or the like.

According to a second aspect of the invention, in the construction machine, the energy saving state is a state such that the engine is made in a prescribed low rotation.

According to the construction machine of the second aspect of the invention, the operator or the like can detect the energy saving state such that the engine is made in a prescribed low rotation.

According to a third aspect of the invention, the energy saving state is a state such that the engine stops.

According to the construction machine of the third aspect of the invention, the operator or the like can detect the energy saving state such that the engine stops.

According to a fourth aspect of the invention, the energy saving state is a state such that the engine stops after the lapse of a predetermined time since the engine is made into a prescribed low rotation and the engine continuously stops.

According to the construction machine of the fourth aspect of the invention, the operator or the like can detect the energy saving state such that the engine stops after the lapse of a predetermined time since the engine is made into a prescribed low rotation and the engine continuously stops.

According to a fifth aspect of the invention, the construction machine can display the energy saving state by the display means 30 by means of a display lamp 33 that is capable of being recognized from the outside of the machine.

According to the construction machine of the fifth aspect of the invention, the operator or the third person who boards at this construction machine to perform work can easily recognize the energy saving state from the outside of the machine, so that the operator or a third person can detect that this construction machine is in the energy saving state now.

According to a sixth aspect of the invention, the construction machine can display the energy saving state by the display means 30 by means of a monitor screen 26 that is provided in an operator's cabin 11 as monitor display.

According to the construction machine of the sixth aspect of the invention, the operator boarding at this construction machine can check the energy saving state by the monitor display on the monitor screen 26 that is provided in the operator's cabin 11.

According to a seventh aspect of the invention, the construction machine can display the energy saving state by the display means 30 by means of a voice generator 34 that is provided in an operator's cabin 11 as voice attention.

According to the construction machine of the seventh aspect of the invention, the operator or a third person can detect that this construction machine is in the energy saving state by the voice attention from the voice generator 34. In this case, if this voice can be heard at the outside of the construction machine, the operator can detect this (the energy saving state) by an auditory sense when he or she approaches to this construction machine; and if this voice can be heard in the operator's cabin 11, the operator can detect this (the energy saving state) by an auditory sense without seeing the monitor screen 26.

According to the construction machine of the first aspect, the operator or the like can know the state (the condition) of this construction machine. Therefore, even when the engine is driven under this state, the operator or a third person can predict that the engine will stop after that, so that the operator or a third person can cope with the operation of the construction machine when the engine stops. In other words, when restarting the work, the operator can restart the work from this energy saving state. For example, even if the ventilation operation is performed upon boarding, the operator can grasp the current state that the construction machine is made into the energy saving state and the engine is stopped, and this makes it possible to eliminate anxieties.

According to the construction machine of the second aspect, the operator or the like can detect the energy saving state such that the engine is made in a prescribed low rotation, so that the he or she can restart the work without anxiety even from such an energy saving state of a prescribed low rotation.

According to the construction machine of the third aspect of the present invention, the operator or the like can detect the energy saving state such that the engine stops, so that he or she can restart the work without anxiety even from such an energy saving state of stopping of the engine.

According to the construction machine of the fourth aspect, the operator or the like can detect the energy saving state such that the engine stops after the lapse of a predetermined time since the engine is made into a prescribed low rotation and the engine continuously stops, so that when the engine is made into the prescribed low rotation, if this is displayed by the display means, he or she can predict that the engine will stop after that and this makes it possible for the operator or the like to restart the work without anxiety.

According to the construction machine of the fifth aspect, the operator or a third person who boards at this construction machine to perform work can easily recognize the energy saving state from the outside of the machine, so that the operator can restart the work without anxiety and a third person other than the operator can grasp the current state of this construction machine to cope with the operation or the like of the construction machine.

According to the construction machine of the sixth aspect, the operator boarding at this construction machine can check the energy saving state by the monitor display on the monitor screen that is provided in the operator's cabin. Therefore, upon boarding, the operator can immediately grasp the energy saving state and can eliminate anxieties.

According to the construction machine of the seventh aspect, the operator or a third person can detect that this construction machine is in the energy saving state by the voice attention from the voice generator. In other words, if this voice can be heard at the outside of the construction machine, the operator can detect this (the energy saving state) by an auditory sense when he or she gets close to this construction machine, so that the operator can stably detect the energy saving state even in daylight when the display light or the like is not viewable; and if this voice can be heard in the operator's cabin, the operator can detect this (the energy saving state) by the auditory sense without seeing the monitor screen, so that it is easy to grasp the energy saving state, it is possible to immediately eliminate anxieties, and the operator or a third person can restart the operation smoothly.

DESCRIPTION OF THE PREFERRED EMBODIMENTS

Figure 1:
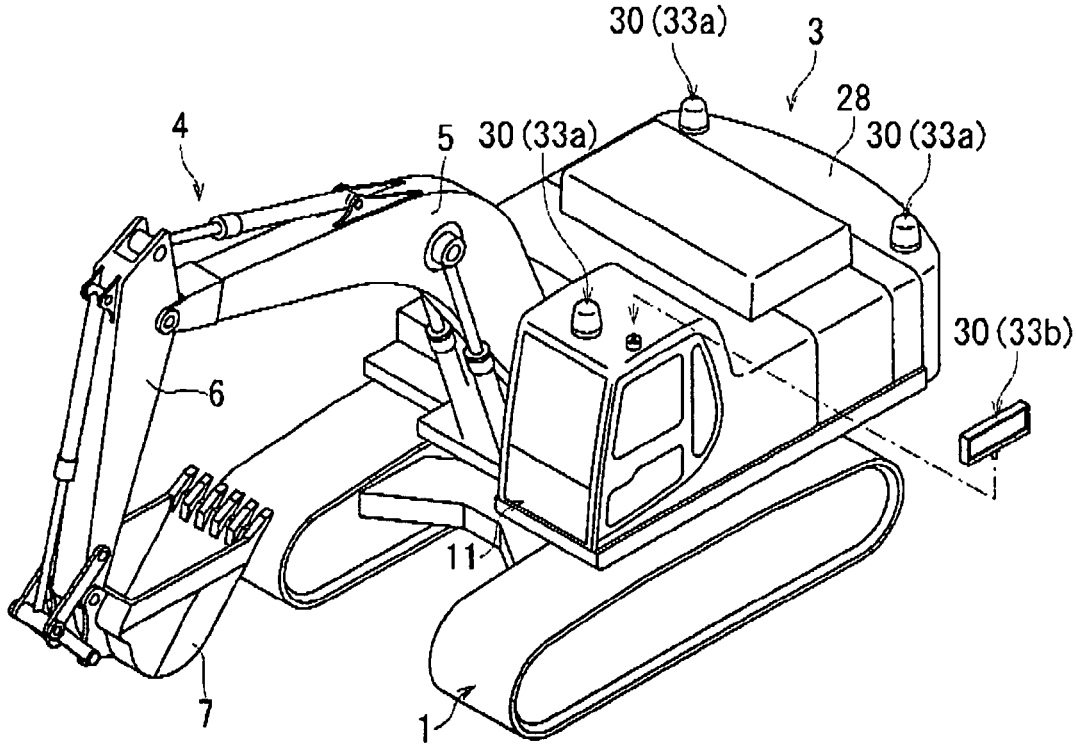
FIG. 1 is a perspective view showing an embodiment of a construction machine of the present invention.

In the next place, with reference to the drawings, specific embodiments of a construction machine of the present invention will be described in detail below. FIG. 1 is a perspective view of the construction machine. This construction machine is a hydraulic excavator and is provided with the lower traveling device 1, and the upper pivoting body 3 to be pivotally fit above the lower traveling device 1 via a pivoting mechanism (not illustrated). The operating machine 4 is continued to the upper pivoting body 3. This operating machine 4 is provided with a boom 5 of which base is swingably coupled to the upper pivoting body 3, an arm 6 that is swingably coupled to the front end of the boom 5, and a bucket 7 that is swingably coupled to the front end of the arm 6. In addition, the upper pivoting body 3 is provided with an operator's cabin 11 or the like.

Figure 2:
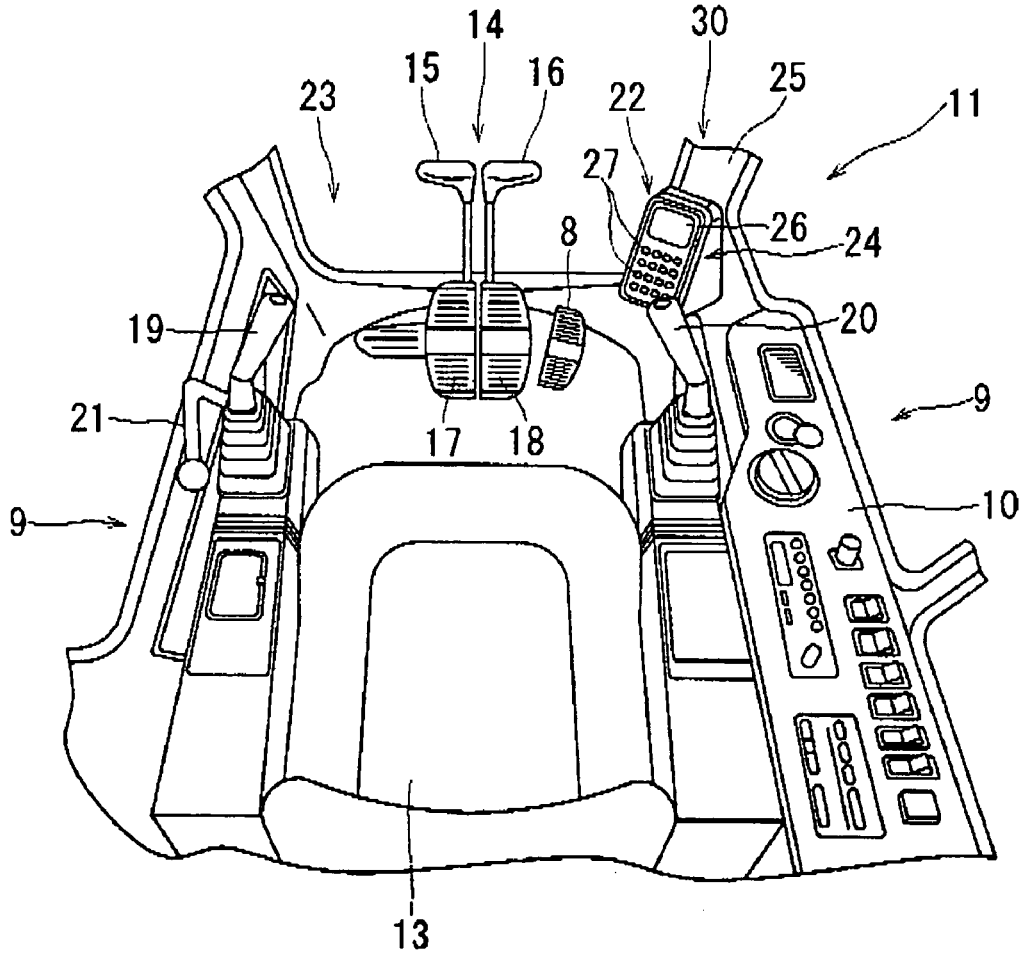
FIG. 2 is a substantial part perspective view of the construction machine.

As shown in FIG. 2, in the operator's cabin 11 of the upper pivoting body 3, the operator's seat 13 is disposed at its center part and traveling operation means 14 is disposed in front of this operator's seat 13. This traveling operation means 14 is provided with traveling levers 15 and 16, and traveling pedals 17 and 18 to swing integrally with the traveling levers 15 and 16 respectively. In this case, if the traveling levers 15 and 16 are pushed forward, the lower traveling device 1 moves forward, and if the traveling levers 15 and 16 are pulled backward, the lower traveling device 1 moves backward. In the meantime, in the vicinity of the traveling operation means 14, a pedal for attachment 8 is disposed, and further, on the side of one side window 9, an instrument panel 10 is located.

In addition, at the side of the operator's seat 13, the operating machine levers 19 and 20 are arranged respectively, These operating machine levers 19 and 20 serve to perform seesaw movement of the boom 5, rotation of the arm 6 and the bucket 7, and the pivoting operation of the upper pivoting body 3. Further, in the vicinity of one operating machine lever 19, the lock lever 21 is provided. In this case, the lock lever 21 serves to stop the operation of the operating machine 4, pivoting of the upper pivoting body 3, and traveling of the lower traveling device 1 or the like. In other words, by performing the pulling-up operation of the lock lever 21, movement of the operating machine 4 or the like can be locked (regulated), and in this state, even if the operating machine levers 19 and 20 or the like are operated, it is possible to prevent the operating machine 4 or the like from operating.

In addition, in the operator's cabin 11 of this construction machine, a monitor device 22 is provided to display the engine state or the like. In this case, the engine state means a temperature of engine cooling water, a temperature of engine oil, and a fuel remaining quantity or the like. In the meantime, this monitor device 22 is arranged at the lower part of a vertical frame 25 partitioning a front window 23 of the operator's cabin 11 and one side window 9, and at a front surface of an external case 24, a monitor screen 26 and operation push buttons 27 are arranged. Further, this monitor screen 26 is made of, for example, a liquid crystal panel.

In the meantime, in this construction machine, the engine is made into the energy saving state when the operator leaves from the operator's seat 13 with no work performed. In this case, the energy saving state means a state such that the work using the operating machine 4 or the like and the traveling operation are not performed, for example, when the engine is made in a low rotation state as an idling state; when the engine is made in a further low rotation state after the lapse of a predetermined time from the above low rotation state; and when the engine stops after the lapse of a predetermined time from these low rotation states (the rotation state upon idling or the further low rotation state from the idling state). This energy saving state is called as an eco state. In addition, in this energy saving state, the operator generally leaves from the operator's seat 13, however, it is also possible that the operator does not leave from there. Therefore, it is possible to define a reference of the energy saving state as a case that the operator leaves from the operator's seat 13 or the operator operates the lock lever 21. In the meantime, it is possible to detect that the operator leaves from the operator's seat 13 by providing a sensor for detecting an operator at the operator's seat 13 or by providing a sensor for detecting the opening and closing motions of a door. In addition, the number of revolution of the engine can be detected by a sensor for detecting the revolution number 31 (refer to FIG. 3) that is annexed to the engine.

Figure 3:
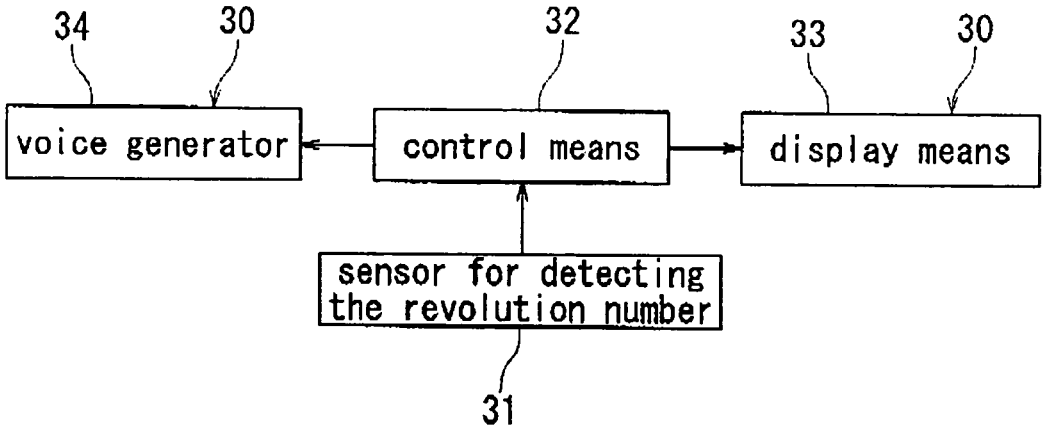
FIG. 3 is a simple block diagram of a control circuit of the construction machine.

Then, if the engine is made into the above-described energy saving state, the display means 30 may display that the current state is the energy saving state. In other words, as shown in FIG. 3, this construction machine may include the above-described sensor for detecting the revolution number 31, control means 32 for judging if the state is the energy saving state with this revolution number inputted, and the above-described display means 30 for displaying the energy saving state when this control means 32 judges the energy saving state. The display means 30 can be configured by a display light 33 that is recognizable from the outside of the machine and a voice generator 34. In addition, the display light 33 can be configured by a rotating light 33*a* and an LED display plate 33*b* or the like. In the meantime, according to the present embodiment, as shown in FIG. 1, the two rotating lights 33*a* are annexed on either side of the upper surface of a counter weight part 28 of the upper pivoting body 3, one rotating light 33*a* is annexed on the upper surface of the operator's cabin 11, and one LED display plate 33*b* is annexed on the upper surface of the operator's cabin 11. In addition, the rotating light 33*a* is provided with a case body, and alighting member and a reflecting member that are stored in this case body; and the reflecting member may rotate. In addition, on the LED display plate 33*b*, the entire surface or the partial surface thereof can be lighted; the characters of "energy saving state" and "eco operating" can be displayed; and further, adding to these characters, a pattern (a pattern set in advance so as to illustrate the energy saving state) can be displayed; and in place of these characters, only a pattern to illustrate the energy saving state can be displayed.

Further, in the display means 30, as shown in FIG. 2, the announcement about the energy saving state is displayed on the monitor screen 26. In this case, as same as the LED display plate 33*b*, the entire of partial monitor screen 26 is lighted; the characters of "energy saving state" and "eco operating" can be displayed; and further, adding to these characters, a pattern (a pattern set in advance so as to illustrate the energy saving state) can be displayed; and in place of these characters, only a pattern to illustrate the energy saving state can be displayed.

In addition, as shown in FIG. 3, providing the voice generator 34, when the control means 32 judges the energy saving state, this voice generator 34 can display the announcement of the energy saving state by the voice attention. In this case, the voice generator 34 may be disposed in the operator's cabin 11 to display the voice toward the operator in the operator's cabin 11 or it may be disposed at the outside of the operator's cabin 11 to display the voice to the outside of the operator's cabin 11. Further, even when the voice generator 34 is disposed in the operator's cabin 11, the voice is audible to the outside, and even when it is disposed at the outside of the operator's cabin 11, the operator in the operator's cabin 11 can hear this. In other words, the voice generator 34 can make the voice attention to be audible to the operator at the outside of the operator's cabin 11. Then, this voice attention may be the words to show the energy saving state, a sound other than the words, for example, a buzzer sound and a melody or the like set in advance to notice the energy saving state.

Figure 4:
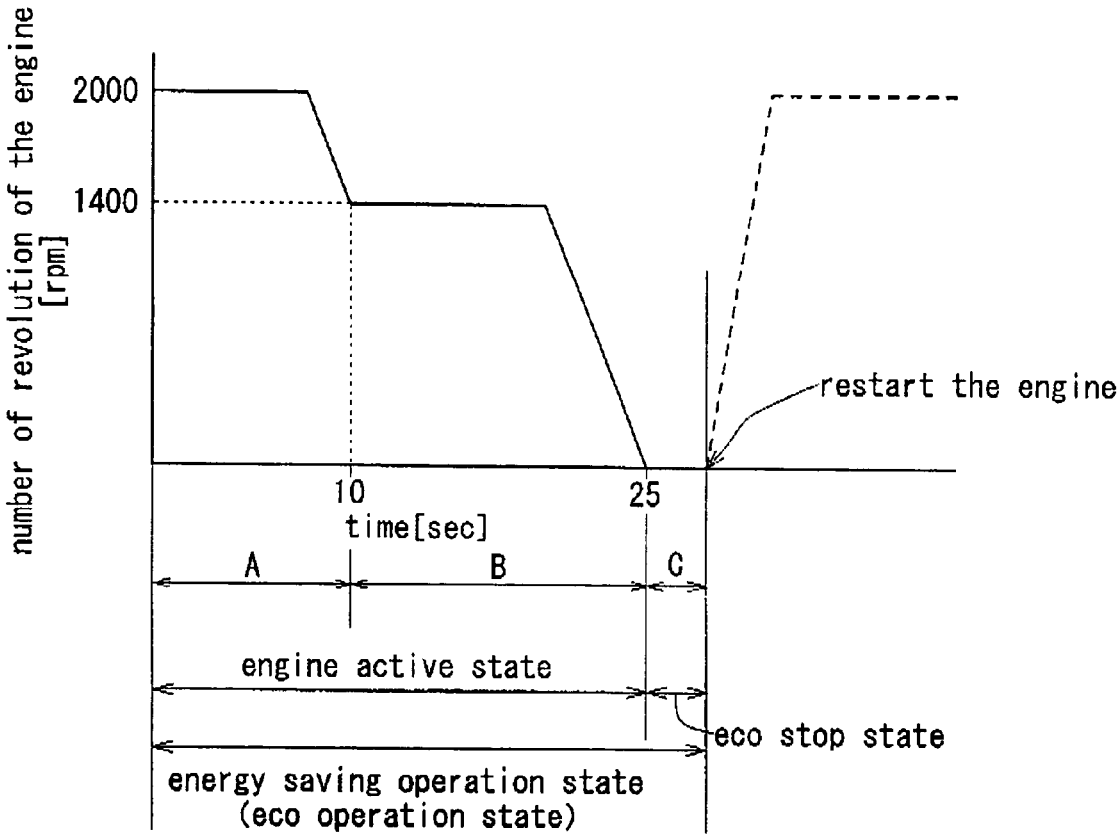
FIG. 4 is an explanatory view of an energy saving state of the construction machine.

As shown in FIG. 4, in the case that the engine is controlled when the number of revolution of the engine is in the idling state, for example, 2000 (rpm), the operator leaves from the operator's cabin 11, a predetermined time (for example, ten seconds) has been lapsed, further, the number of revolution of the engine is lowered to a predetermined low rotation (for example, 1400 (rpm)), and then, a predetermined time (15 seconds) has been further lapsed, the engine will stop after 25 seconds since the engine is entered in the idling state and the operator leaves from the operator's cabin 11. The 25 seconds are an engine activate state (an eco operation state). After that, this state can be referred to as an engine stop state (eco stop state) upon the energy saving operation, and further, this engine activate state (a range A+a range B) and the engine stop state (a range C) from stop of the engine to the restart thereof can be referred to as the above-described energy saving state. Accordingly, according to this construction machine, in the energy saving operation state (the range A+ the range B+ the range C), the display means 30 may display the energy saving state. In the meantime, omitting the range A from the energy saving operation state, only in (the range B+ the range C), the energy saving state may be displayed. In addition, the energy saving state is unlocked when the operator boards at the machine again to restart the engine.

It is preferable that the display light 33 constantly displays the announcement of the energy saving state in the energy saving state, however, the monitor display in the operator's cabin 11 may be constantly displayed or may be displayed when the operator boards at the operator's cabin 11 again because the monitor display is meaningless when the operator does not board at the operator's cabin 11 since the monitor display in the operator's cabin 11 is not viewable from the outside. In the meantime, it is possible to check that the operator boards at the operator's cabin 11 again by detecting if the operator is located in the operator's seat 13 and by detecting the open and close operation of the door.

According to the above-described construction machine, by means of the display means 30, the operator or the like can know the state (condition) of this construction machine. Therefore, even if the engine is activated in this state, the operator can predict that the engine will stop after that, so that the operator or the like can cope with the operation or the like of the construction machine to be performed due to stop of the engine. In other words, upon restarting the work, the operator or the like can restart the work from this energy saving state without anxieties. In addition, since the operator or the like can detect the energy saving state such that the engine is in the predetermined low rotation and the engine stops, the operator or the like can restart the work from the energy saving state in such a predetermined low rotation state without anxieties. Further, in the end of the work, the operator stops the engine with a key turned off or a key pulled out and the ventilation operation also stops. However, even if the engine stops in the energy saving state, the ventilation operation or the like has been continued. As a result, the operator other than the operator who suspends the work boards at this construction machine without grasping that the engine stops in the energy saving state, if the ventilation operation or the like is performed, this causes the operator to feel anxieties because he or she has no idea of why the ventilation operation or the like is performed. However, according to this construction machine, in the energy saving state, the operator can grasp the energy saving state, so that if the ventilation operation is performed in the operator's cabin 11, the operator or the like does not feel anxieties.

Further, if the display means 30 is the display light 33, the operator or the third person who boards at this construction machine to perform work can detect that this construction machine is currently in the energy saving state, so that the operator can board at the construction machine to perform the work without anxieties, and a third person can grasp the current state of this construction machine to cope with the operation or the like of the construction machine. In addition, if the display means 30 is the monitor screen 26 that is provided in the operator's cabin 11, the operator boarding at this construction machine can check that the engine is made in the energy saving state by the monitor display on the monitor screen 26. Therefore, when boarding at the machine, the operator can immediately grasp the energy saving state of the engine to eliminate anxieties. In addition, if the display means 30 is the voice generator 34, the operator or a third person can detect that the engine is made in the energy saving state by voice attention from the voice generator 34. In other words, if this voice is audible at the outside of the construction machine, when the operator or a third person gets close to this construction machine under the energy saving state, he or she can detect this (namely, the energy saving state) by the auditory sense. As a result, the operator can stably detect the energy saving state even in daylight when the display light 33 or the like is not viewable, and if this voice can be heard in the operator's cabin 11, the operator can detect this (the energy saving state) by the auditory sense without seeing the monitor screen 26 or the like, so that it is easy to grasp the energy saving state, it is possible to immediately eliminate anxieties, and the operator can restart the operation smoothly.

The specific embodiments of the present invention are as described above, however, the present invention is not limited to the above-described embodiments and various modifications will become possible without departing from the scope the present invention. For example, the energy saving state may be the state where an automatic deceleration function is operated. Here, the automatic deceleration function is a function such that the number of revolution of the engine is lowered to a first deceleration (for example, lowered to about 50 to 150 rpm) at once (for example, about 0.2 second) when all operation levers such as the traveling levers 15 and 16, and the operating machine levers 19 and 20 or the like are made in a neutral position, further, after the lapse of a predetermined time (for example, about 4 seconds), the number of revolution of the engine is lowered to a second deceleration (for example, about 1400 rpm), and this number of revolution of the engine is maintained (held) till the lever is operated. In addition, the display means 30 may include only the display light 33 that can be checked from the outside of the machine, may include only the monitor device 22, may include only the voice generator 34, and further, may include any two among them, however, it is preferable that the display means 30 includes all of them. In other words, when the noise of a working scene is large, it is feared that the voice from the voice generator 34 is not audible due to the voice and it is feared that the display of the display light 33 is not viewable in daylight, so that providing the display light 33 or the like capable of being detected visually and providing the voice generator 34 capable of being detected by the auditory sense, it is possible to detect the energy saving state reliably. In addition, the display light 33 may be configured only by the rotation light 33*a* and may be configured only by the LED display plate 33*b*. Further, the number and the place of the display light 33 to be annexed to the upper pivoting body 3 may be arbitrarily changed. In addition, in place of the rotation light 33*a*, a flashing light may be available and in place of the LED display plate 33*b*, a liquid crystal panel or the like may be available. Then, when displaying the energy saving state on the monitor device 22, a position of this monitor device 22 is preferably positioned at a place where the operator can observe the monitor screen 26 when seating at the operator's seat 13, however, this is not limited to the position shown in FIG. 1. In addition, in the case of the monitor display, according to the above-described embodiment, the existing monitor device 22 displaying the engine state or the like displays the energy saving state, however, separately providing a monitor device for displaying the energy saving state that is different from such an existing monitor device 22, this monitor device for displaying the energy saving state may display the energy saving state. In addition, the predetermined low rotation number for judging the energy saving state, a time till this predetermined low rotation number, and a time from the predetermined low rotation number till stop of the engine or the like are shown in FIG. 4, however, it is a matter of course that they are not limited to these numeric values shown in FIG. 4 and they can be arbitrarily set. Further, the construction machine is not limited to the hydraulic excavator and various machines such as a crane and a crushing machine or the like may be available.

What is claimed is:

1. A construction machine having an engine, an operator's cabin and an operator's seat, wherein the engine is controlled to be in an energy saving state when an operator leaves from the operator's seat and no work is performed, the construction machine comprising: display means for indicating that the engine is in said energy saving state, said display means being activated absent operator intervention.

2. The construction machine according to claim 1, wherein said energy saving state is a state such that the engine is controlled to be in a prescribed low rotation.

3. The construction machine according to claim 1, wherein said energy saving state is a state such that the engine stops.

4. The construction machine according to claim 1, wherein said energy saving state is a state such that the engine stops after the lapse of a predetermined amount of time since the engine is controlled to be in a prescribed low rotation state and the engine remains stopped.

5. The construction machine according to any one of claims 1 to 4, wherein said display means is a display lamp that is capable of being recognized from outside of the operator's cabin.

6. The construction machine according to any one of claims 1 to 4, wherein said display means is a monitor screen that is provided in the operator's cabin for a monitor display.

7. The construction machine according to any one of claims 1 to 4, wherein said display means is a voice generator that is provided in the operator's cabin for providing voice attention.

* * * * *